US005474272A

United States Patent [19]

Thompson et al.

[11] Patent Number: 5,474,272

[45] Date of Patent: Dec. 12, 1995

[54] PORTABLE CUP HOLDER WITH ADJUSTABLE CUP RETAINER

[75] Inventors: William Thompson; Thomas J. O'Brien, both of Kansas City, Mo.; Donald L. Rohrs, Lenexa, Kans.

[73] Assignee: Holdit, Inc., L.L.C., Kansas City, Mo.

[21] Appl. No.: 242,377

[22] Filed: May 13, 1994

[51] Int. Cl.[6] ..... A47K 1/08

[52] U.S. Cl. ..... 248/311.2; 248/912; 297/188.18

[58] Field of Search ..... 248/311.2, 205.2, 248/214, 231, 912, 313, 911, 172; 297/188.17, 188.14, 188.19, 188.18

[56] References Cited

U.S. PATENT DOCUMENTS

| | | | |
|---|---|---|---|
| 2,963,761 | 12/1960 | Haydock | 24/257 |
| 3,215,467 | 11/1965 | McFarland et al. | 297/194 |
| 3,675,969 | 7/1972 | Gage | 297/194 |
| 3,690,724 | 9/1972 | Douglas et al. | 297/194 |
| 4,262,962 | 4/1981 | Yust | 297/194 |
| 4,548,326 | 10/1985 | Danna et al. | 211/71 |
| 4,728,147 | 3/1988 | Dutton | 297/194 |
| 4,795,211 | 1/1989 | Stern et al. | 297/194 |
| 4,863,134 | 9/1989 | Young et al. | 248/311.2 |
| 5,232,262 | 8/1993 | Tseng | 297/194 |
| 5,234,251 | 8/1993 | Ayotte | 297/194 |
| 5,238,212 | 8/1993 | Dechellis | 248/311.2 |
| 5,249,770 | 10/1993 | Louthan | 248/311.2 |
| 5,295,650 | 3/1994 | Brandt | 248/311.2 |
| 5,302,000 | 4/1994 | Ayotte | 297/194 |

*Primary Examiner*—Leslie A. Braun
*Assistant Examiner*—Anita M. King
*Attorney, Agent, or Firm*—Kokjer, Kircher, Bowman & Johnson

[57] ABSTRACT

A cup-holder is provided for portable use at football games, theaters, or the like. The cup-holder is securely fastened to a top surface of an arm rest of a seat at the game. The holder includes a base having flat top and bottom surfaces. The bottom surface of the base rests flush against the seat arm rest or may fit over the arm rest. The top of the base is flat to allow the user to rest his/her arm thereon. The holder includes a cup receptacle formed from adjacent, contiguous rings which are separated with a flexible bridge. VELCRO fastening tape straps are used to secure the holder to the arm rest. Also, the top surface of the base may include indicia such as a team logo, name, team schedule, etc.

12 Claims, 1 Drawing Sheet

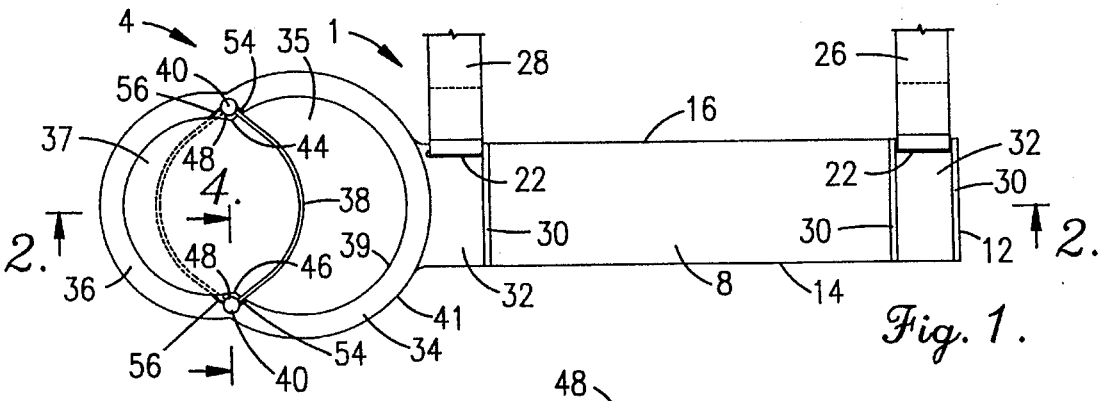
Fig. 1.
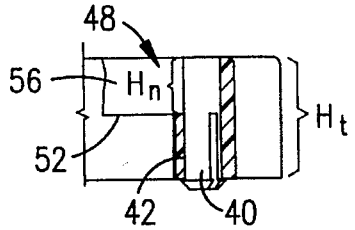
Fig. 4.
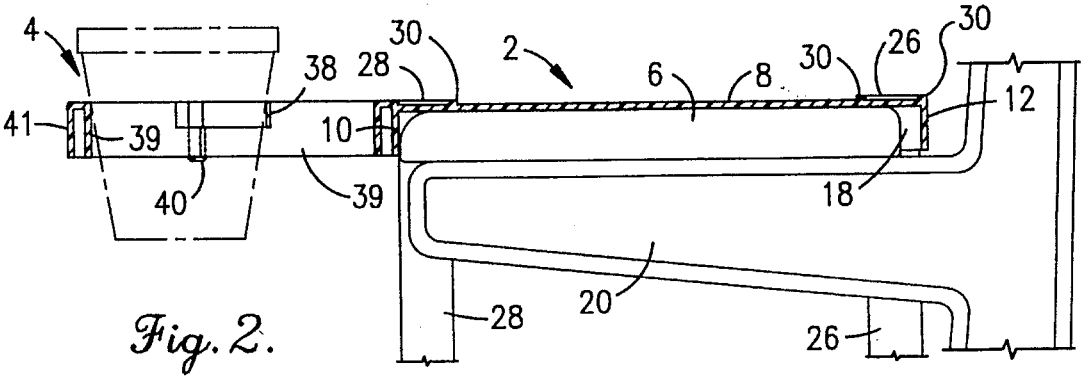
Fig. 2.
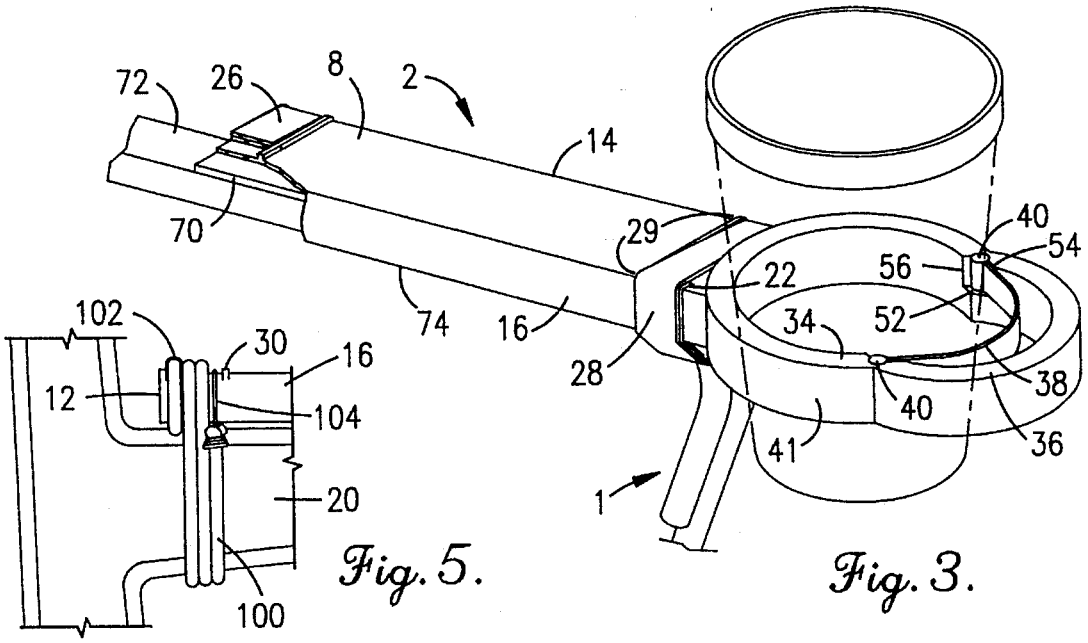
Fig. 5.
Fig. 3.

PORTABLE CUP HOLDER WITH ADJUSTABLE CUP RETAINER

BACKGROUND OF THE INVENTION

The present invention generally relates to a cup holder which is releasably secured to the arm rest of a chair to receive cups of multiple sizes.

In the past, cup holders have been proposed which are securely mounted to an arm rest, such as in a theater, stadium and the like. These conventional cup holders may be separated into two primary groups, namely those which are permanently secured to, and form a portion of, an arm rest and those which are detachably secured to the arm rest. Examples of the former group may be found in U.S. Pat. Nos. 5,234,251 (Ayotte); 4,863,134 (Young et al.); 4,795,211 (Stern et al.); and 3,675,969 (Gage). Examples of the latter group may be found in U.S. Pat. Nos. 5,238,212 (Dechellis); 4,548,326 (Danna et al.); 4,262,962 (Yust); and 3,690,724 (Douglas et al).

The patent to Danna et al. discloses a stadium seat arm gripping tray which is detachably secured to the arm of the seat. Danna's tray includes a tray portion and an arm portion. The arm portion includes side walls that extend downward along either side of the seat arm. The side walls include lips, extending inwardly to engage outer bottom edges of the arm rest. Danna suggests alternative configurations for releasably fastening the tray to the arm rest.

The patent to Douglas et al. discloses a support mounted on a chair, for holding glasses, cups, ash trays, and the like. Douglas uses a pair of fittings to hold the desired objects. The fittings are formed on a panel which has in turned ends that bend down and under a main part of the panel and beneath opposite ends of a main panel. The main panel includes a down turned edge portion and the second panel includes a down turned edge portion. The edge portions are adapted for gripping either side of a chair arm to hold the entire apparatus on the chair arm.

The patent to Dechellis discloses a beverage container that includes a cavity that receives the arm. Dechellis uses spring fasteners in the cavity to hold the container on the arm. The patent to Yust also discloses a holder including a T-shaped recess that receives and holds a top flange of the arm rest.

The patent to Gage attaches a cup receptacle with screws to an inner wall of the chair arm. The patent to Ayotte mounts an arm attachment to the chair arm with mounting screws and then inserts a padded upper surface over the screws and within a rectangular recess in the top of the attachment. The patent to Stern et al. discloses a holder mounted on an armrest of a stadium or theater seat. Within Stern's patent, the armrest portion has an upper wall with vertical posts that are adapted to receive shanks of corresponding fasteners to clamp the holder onto the armrest. The patent to Young et al. discloses a cup holder having structural elements that extend downward from the bottom surface of a beam member. Within Young's patent the structural elements define a pattern of cavities which cooperate with a corresponding configuration of recesses and tabs in the chair arm to secure the holder to the arm rest.

However, each of these prior art systems have met with limited success since each conventional cup holder is only useful with armchairs having similar constructions. None of these cup holders are truly universal. While the cup holders to Danna et al., Douglas et al. and Dechellis may be useful with more than one specific arm rest configuration, these cup holders use a plastic molded structure to achieve attachment. Thus, these cup holders are only useful with arm rests which fit within this molding, thereby limiting their versatility. The former group of cup holders are rigidly secured to the arm rest and constructed to fit integrally within a single type of arm rest. Thus, these cup holders offer practically no versatility. Moreover, when it is desirable to move the cup holder to a new arm rest, substantial manual labor is involved since the cup holder and arm rest must be partially disassembled to effect release and attachment.

Finally, each of the foregoing cup holders utilize cup receptacles having a single configuration which may receive a limited set of cup sizes. The patent to Yust offers multiple receptacles, but each is the same size. The patents to Stern et al., Young and Ayotte utilize a single cup receptacle having a multi-ledged or staged cross-section therein to enable the receipt of large and small cups. However, even this design is limited since in only receives the bottom most portion of cups having a bottom size too large to pass through the receptacle's lower stage. Thus, the receptacle holds large cups somewhat unstably. This stability may be increased solely by increasing the thickness of the uppermost stage in the receptacle. This design is further disadvantageous as it holds the cup in a position substantially above the arm rest which is cumbersome and more likely to be bumped. Thus, multi-stage receptacles are only able to receive small cups stably since only small cups pass through the lower stage. Further, the upper and lower stage sizes must be relatively close in diameter, otherwise it would be inoperative with an intermediate range of cup sizes. The largest stage only receives the bottommost portion of a cup. To do so, it must have a diameter substantially equal to that of the cup, otherwise the cup contacts the top edge of the lower stage without being securely received within the upper stage. Thus, if the upper stage is substantially larger than the lower stage, an intermediate size cup could be inserted too large to pass through the lower stage, but too small to fit snugly in the upper stage. Hence, the range of potential cup sizes is still limited.

The need remains in the industry of an improved cup holder. It is the object of the present invention to meet this need, and to overcome drawbacks previously experienced.

SUMMARY OF THE INVENTION

It is an object of the present invention to provide a cup holder which is releasably securable to a wide variety of arm rest designs.

It is another object of the present invention to provide a portable cup holder which is easily secured to, and removed from, an arm rest and compact for carrying.

It is another object of the present invention to provide a cup holder having an adjustable cup receptacle for receiving a wide variety of cup sizes without being overly thick or wide.

In summary, a cup-holder is provided for portable use at football games, theaters, or the like. The cup-holder is securely fastened to a top surface of an arm rest of a seat at the game. The holder includes a base having flat top and bottom surfaces. The bottom surface of the base rests flush against the seat arm rest or may fit over the arm rest. The top of the base is flat to allow the user to rest his/her arm thereon. The holder includes a cup receptacle formed from adjacent, contiguous rings which are separated with a flexible bridge. VELCRO fastening straps are used to secure the holder to the arm rest. Also, the top surface of the base may include indicia such as a team logo, name, team schedule, etc.

BRIEF DESCRIPTION OF THE DRAWINGS

The objects and features of the invention noted above are explained in more detail with reference to the drawings, in which like reference numerals denote like elements, and in which:

FIG. 1 denotes a top planar view of the present invention;

FIG. 2 denotes a side sectional view of the present invention taken along line 2—2 in FIG. 1;

FIG. 3 illustrates a perspective view of the present invention;

FIG. 4 illustrates a side sectional view taken along line 4—4 in FIG. 1 of a rotary connector supporting the flexible bridge; and FIG. 5 illustrates an alternative embodiment for the mounting assembly according to the present invention.

DETAILED DESCRIPTION OF THE INVENTION

FIG. 1 generally illustrates a cup holder 1 according to the present invention. The cup holder 1 includes a rectangular shaped base section 2 integrally formed with a cup retainer 4 on one end thereof. The base 2 may be constructed from materials such as plastic, through injection molding and the like. In one embodiment, the base 2 is constructed with a hollow rectangular body having a top surface 8, front and back ends 10 and 12, and opposite side walls 14 and 16. The top and walls (8–16) combine to form a cavity 18 which securely receives a padding insert 6. The padding 6 may be fastened to the base 2 in any known manner. The padding insert 6 is constructed of a flexible resilient material having frictional engaging characteristics, such as rubber. The padding insert 6 ensures that the cup holder 1 is evenly, levelly and securely supported upon the arm rest 20.

Referring to FIG. 1, the top surface 8 includes slots 22 extending therethrough and arranged at opposite ends of the base. The slots 22 are aligned along the length of the base 2 and receive one end of securing straps 26 and 28. The securing straps 26 and 28 include VELCRO fastening strips 29 on one end opposite to the end secured to the base 2. The VELCRO fastening strips 29 secure the straps 26 and 28 to themselves once wrapped around the arm rest. The top surface 8 further includes raised ridges 30 extending transverse to the base 2. The raised ridges 30 are located proximate the ends of the slots 22 to provide channels 32 therebetween. The raised ridges 30 function to retain and guide the securing straps 26 and 28 within a desired position once mounted about an arm rest 20. The raised ridges 30 further act as a shield to minimize interference with the straps 26 and 28, such as while a user rests an arm upon or slides it across the top surface 8.

Referring to FIGS. 1 and 3, the cup retainer 4 is constructed with first and second partial rings 34 and 36. The first and second rings 34 and 36 are constructed contiguous with one another to form an egg-shaped opening having first and second semi-circular cup holding apertures 35 and 37. The cup retainer 4 is constructed with walls having a U-shaped cross-section formed from inner and outer walls 39 and 41 to enhance its rigidity (as illustrated in FIG. 2). The first and second rings 34 and 36 intersect to form internally directed apexes 44 and 46 located opposite one another. The cup retainer 4 provides a single smooth inner wall 39 which receives the cup, but for notched regions 48 (FIG. 4) proximate each apex 44 and 46. The notches 48 form a ledge 52 extending in a direction perpendicular to the height $H_t$ of the cup retainer 4. The notches 48 are cut to a depth $H_n$ (FIG. 4) equaling approximately half the height $H_t$ of the cup retainer 4. The ledges 52 include receiving holes 42.

The apexes 44 and 46 are joined with a flexible bridge 38 which bends to a first cup holding position 60 to form the first cup holding aperture 35 and to a second cup holding position 58 to form the second cup holding aperture 37. The bridge 38 is formed of a flexible material, such as plastic, with pivot pins 40 integrally mounted on opposite ends thereof. The pivot pins 40 are received within the holes 42 within the cup retainer 4. The flexible bridge 38 is constructed with a height approximately equal to the depth $H_n$ of the notch (i.e. approximately half the thickness $H_t$ of the cup retainer 4). The pivot pins 40 are constructed with sufficient length to be rotatably received within the holes 42.

The notches 48 are constructed with backing walls 54 and 56 aligned at approximately a right-angle with respect to one another. Optionally, the backing walls 54 and 56 may form an obtuse angle sufficient to allow the flexible bridge 38 to bend between first and second cup retaining positions 58 and 60. The flexible bridge 38 is constructed with sufficient length to form an arc having a radius at least equal to that of the second ring 36. This arcuate configuration ensures that the bridge 38 will not limit the size of a cup received by the second ring 36 when positioned in the second cup retaining position 60. FIG. 2 illustrates a cup (in shadow lines) which is held between the second ring 36 and the bridge 38. FIG. 3 illustrates a cup (in shadow lines) which is held within the first ring 34. The flexible bridge 38 does not necessarily contact and support cups received within the first ring 34 as this ring has sufficient arcuate length to support the cup. The flexible bridge 38 is primarily intended to retain and support cups received within the second ring 36.

The first and second rings 34 and 36 are constructed with differing diameters, such that the first ring 34 is able to receive cups, the diameter of which is entirely independent of the diameter of the second ring 36. In this manner, the first ring 34 is able to expand the range of retainable cups. As the first and second rings 34 and 36 are not dependent upon one another, they may retain cups having extremely small and extremely large diameters. Also, the first ring 34 allows the bottom end of each cup to pass therethrough and be more securely retained.

The first and second rings 34 and 36 are aligned such that their respective center points are located along a longitudinal axis of the base 2 which extends along the center length of the base 2. Optionally, the first and second rings 34 and 36 may be offset to one side, with respect to this longitudinal axis, such that the centers of the first and second rings 34 and 36 lie upon an axis which forms an obtuse angle with the longitudinal axis of the base 2. This alternative embodiment enables the cup holder to be used upon arm rests adjacent a barrier (such as the arm rest upon a door of a car). By arranging the rings 34 and 36 at an angle to the base 2, the cup holder 1 provides room between the cup and the car door for a user's hand.

FIG. 3 illustrates an alternative embodiment for the base 2, in which the back end 12 thereof is removed. A thin padding insert 70 is adhesively secured within the cavity 18. The insert 70 is secured to the under surface of the top 8. This alternative embodiment enables the cup holder 1 to be used with an arm rest 72 having a maximum known width which fits between the side walls 14 and 16. If the cup holder 1 is used with an arm rest having a width greater than the configuration of arm rest 72, then the invention is still usable. If the arm rest 72 is too wide to fit within the cavity 18, then the side walls 14 and 16 merely rest upon the arm rest 72. The bottom surfaces 74 of the side walls 14 and 16 may be constructed with padding similar to the insert 70 to further prevent slippage between the arm rest 72 and the cup holder 1.

FIG. 5 illustrates an alternative embodiment for the securing strap which is constructed of a "Bungee" cord 100. The cord 100 includes one end that is received through the mounting slots 22 and clamped to itself with a clamp 102. The opposite end of the cord 100 includes a securing hook 104 or the like. The cord 100 is flexible and elastic, such that it is able to be wrapped around the arm rest at least one time. The hook 104 may be releasably fastened to the cup holder or to the bottom or top of the arm rest.

During operation, the cup holder 1 is placed on the arm rest 20 or 72 and the securing straps 26 and 28 are wrapped around opposite ends of the arm rest. The VELCRO fastening tape outer portions 29 of the securing straps 26 and 28 facilitate this securing operation. Once the base 2 is securely in place, the flexible bridge 38 may be moved to one of the first and second cup retaining positions 58 and 60 depending upon the size of the cup to be held. Thereafter, the cup may be inserted and held by the second ring 36 and bridge 38 or by the first ring 34.

From the foregoing it will be seen that this invention is one well adapted to attain all ends and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings 1–5 is to be interpreted as illustrative, and not in a limiting sense.

The invention claimed is:

1. A cup holder for releasable attachment to an armrest, said cup holder comprising:

an elongated base having a bottom surface for adjoining a top surface of said armrest, and front and back ends;

at least one flexible securing strap, having one end securely affixed to said base proximate one of said front and back ends thereof and a second end for securing said base to said armrest; and a cup retainer formed upon said front end of said base, said cup retainer including first and second partial rings formed contiguous with, and overlapping, one another, said first and second rings differing in diameter.

2. A cup holder according to claim 1, further including two securing straps, each at opposite ends of said base, each strap including an outer end having a fastening portion for securing said straps about said armrest.

3. A cup holder according to claim 1, wherein said cup retainer includes a flexible bridge having opposite ends pivotally secured to said cup retainer proximate intersecting points between said first and second rings.

4. A cup holder according to claim 3, wherein said flexible bridge moves between a first position, to allow cups to be retained within said first ring, and a second position, to allow cups to be retained within said second ring.

5. A cup holder according to claim 1, wherein said first and second rings are aligned such that centers thereof are positioned along a longitudinal axis extending through a center of said base.

6. A cup holder according to claim 1, wherein said first and second rings are aligned such that centers thereof are positioned along a line which forms an obtuse angle with a longitudinal axis extending through a center of said base.

7. A cup holder according to claim 1, further comprising a padded insert formed upon a bottom side of said base to provide frictional engagement between said base and said armrest.

8. A cup holder according to claim 1, wherein said first and second rings join to form apexes directed internally toward a center of, and opposite one another across, a retaining portion of said cup retainer, said apexes including notched portions having a depth approximately equal to half of a depth of said cup retainer, said notched portions forming ledges having holes therein for pivotally retaining a flexible bridge that extends across said retaining portion.

9. A cup holder according to claim 8, wherein said notched portions include first and second backing walls forming an angle equal to or greater than a right-angle with one another to provide a pivoting area for said flexible bridge.

10. A cup holder according to claim 1, said base including a top surface with slots therein for fastenably receiving one end of at least one securing strap.

11. (Amended) A cup holder according to claim 10, said top surface including raised ridges that traverse said base and form channels between said ridges, said at least one securing strap being securely retained within said channels when in a fastened position.

12. A cup holder according to claim 1, wherein said securing strap is a flexible elastic cord with a hook on one end for being releasably secured to the arm rest.

* * * * *